United States Patent [19]

Hsu

[11] 4,391,020

[45] Jul. 5, 1983

[54] GRAVITY RETURN HINGE HAVING AN AXLE ROD IN AN AXLE SLEEVE

[75] Inventor: Yun-Tung Hsu, Taipei, Taiwan

[73] Assignee: Pei-Liang Chiu, Taipei, Taiwan

[21] Appl. No.: 270,213

[22] Filed: Jun. 3, 1981

[51] Int. Cl.[3] ..... E05F 1/04

[52] U.S. Cl. ..... 16/314; 16/316; 49/239

[58] Field of Search ..... 16/275, 313, 314, 315, 16/316; 49/236, 237, 239

[56] References Cited

U.S. PATENT DOCUMENTS

| | | | |
|---|---|---|---|
| 952,211 | 3/1910 | Perego | 49/239 |
| 1,374,437 | 4/1921 | Coombs | 16/313 |
| 4,200,957 | 5/1980 | Hsu | 16/314 |
| 4,259,763 | 4/1981 | Hsu | 16/314 |

*Primary Examiner*—Paul A. Bell
*Assistant Examiner*—Fred A. Silverberg
*Attorney, Agent, or Firm*—Cushman, Darby & Cushman

[57] ABSTRACT

An automatic return hinge having a primary and a secondary hinge, the primary hinge being furnished with an axle rod with spiral grooves, three locating balls in an axle sleeve roll along the spiral grooves on the axle rod as the door is opened and closed.

5 Claims, 20 Drawing Figures

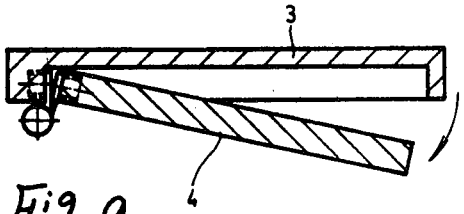
Fig. 9
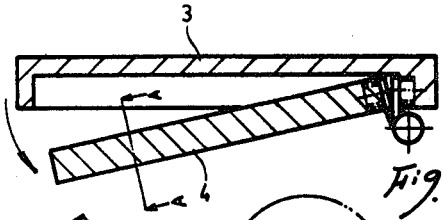
Fig. 8
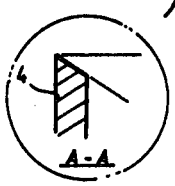
Fig. 8-1
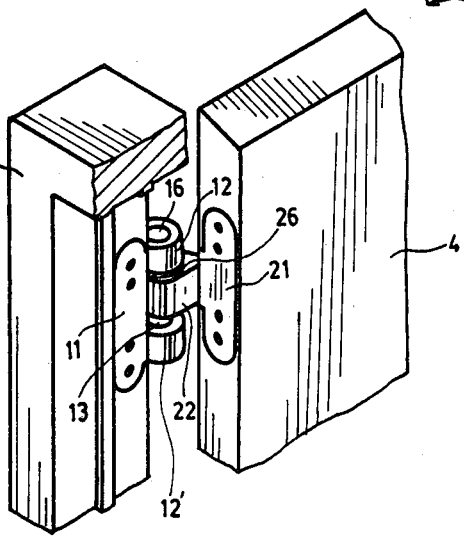
Fig. 2
Fig. 11
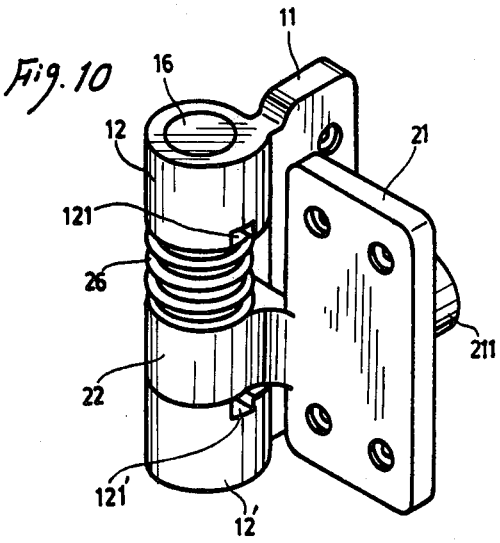
Fig. 10
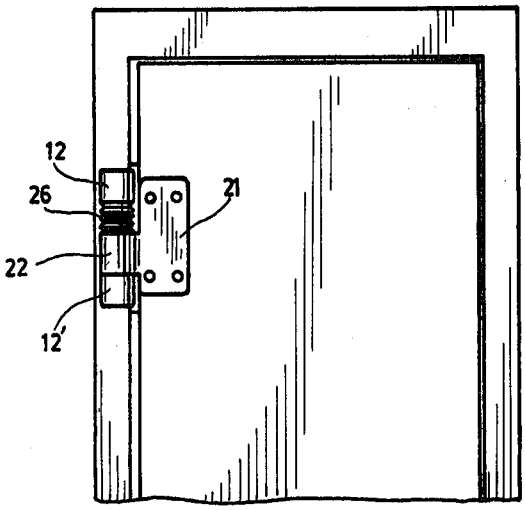
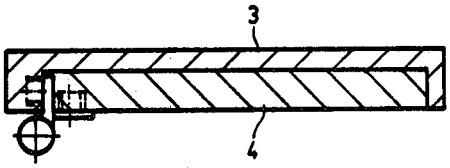
Fig. 12
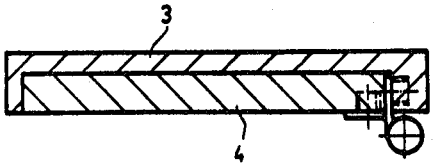
Fig. 13

GRAVITY RETURN HINGE HAVING AN AXLE ROD IN AN AXLE SLEEVE

BRIEF SUMMARY OF THE INVENTION

This invention provides an automatic return hinge, which comprises one primary hinge and one secondary hinge; said primary hinge is furnished with an axle rod with spiral groove, an axle sleeve, inside of which three locating balls are provided and corresponding to the spiral grooves on the axle rod.

When opening the door, the door will rotate upwards as a result of said locating balls rolling slantingly along said spiral grooves.

As soon as the door opening operation is ended, the door will be closed automatically as a result of the gravity effect of door itself.

In the secondary hinge, a universal correction means is furnished for timely correcting any deviation of door axle so as to have the door returned smoothly.

THE BACKGROUND OF THE INVENTION

Most of the conventional hinges usually comprise two hinge pieces (left and right) being coupled together with an axle rod going thru the dovetail-shaped sleeves, which may be disassembled if necessary. Upon being attached between the door and the door jamb, the door will be hinged on the jamb for opening and closing; however, said conventional hinges cannot have the door returning to its closed position. To close the door, a separate device must be used to fulfill the automatic return operation, such as, a hydraulic device or return spring means, etc.

BRIEF DESCRIPTION OF THE DRAWINGS

FIGS. 1-1, 1-2 shows the assembled sectional and top views of the axle sleeve and the axle rod in this invention.

FIG. 1-3 shows the developed view of the spiral grooves on the axle rod.

FIG. 1-4 shows an axle rod with leftward spiral grooves.

FIG. 2 shows the primary hinge being installed in place.

FIG. 3 shows an assembled primary hinge (door being closed) of this invention.

FIG. 4 shows a sectional view of the primary hinge (door being opened) of this invention.

FIG. 5-1 shows the axle rod and the steel ball of the secondary hinge being assembled.

FIGS. 6-1, 6-2 are enlarged views of the portion encircled with dotted line in FIG. 6.

FIG. 8 shows a door to be opened counter-clockwise.

FIG. 8-1 shows a sectional view of a door.

FIG. 9 shows a door to be opened counter-clockwise.

FIG. 10 shows another embodiment of this invention.

FIG. 11 shows the installation position of the embodiment in FIG. 10.

FIG. 12 shows the embodiment in FIG. 10 to be opened clockwise.

FIG. 13 shows the embodiment in FIG. 10 to be opened counter-clockwise.

DETAILED DESCRIPTION

This invention provides an "automatic return hinge", which can have a door returning to its original shutting position by means of gravity, and which comprises a primary hinge to be installed to the upper portion of the door and the jamb, and a secondary hinge to be installed to the lower portion of the door and the jamb. Said primary hinge includes an axle rod with spiral grooves, and said axle rod is to be sleeved by an axle sleeve being furnished with locating balls, and said balls are to be engaged into said spiral grooves for the purpose of having the door to rotate slantingly when being opened, and of having the door returning to original position automatically after door-opening operation being completed. Said secondary hinge is furnished with a universal correction means to timely correct any deviation on the axle so as to have the door returning smoothly.

Figure 1:
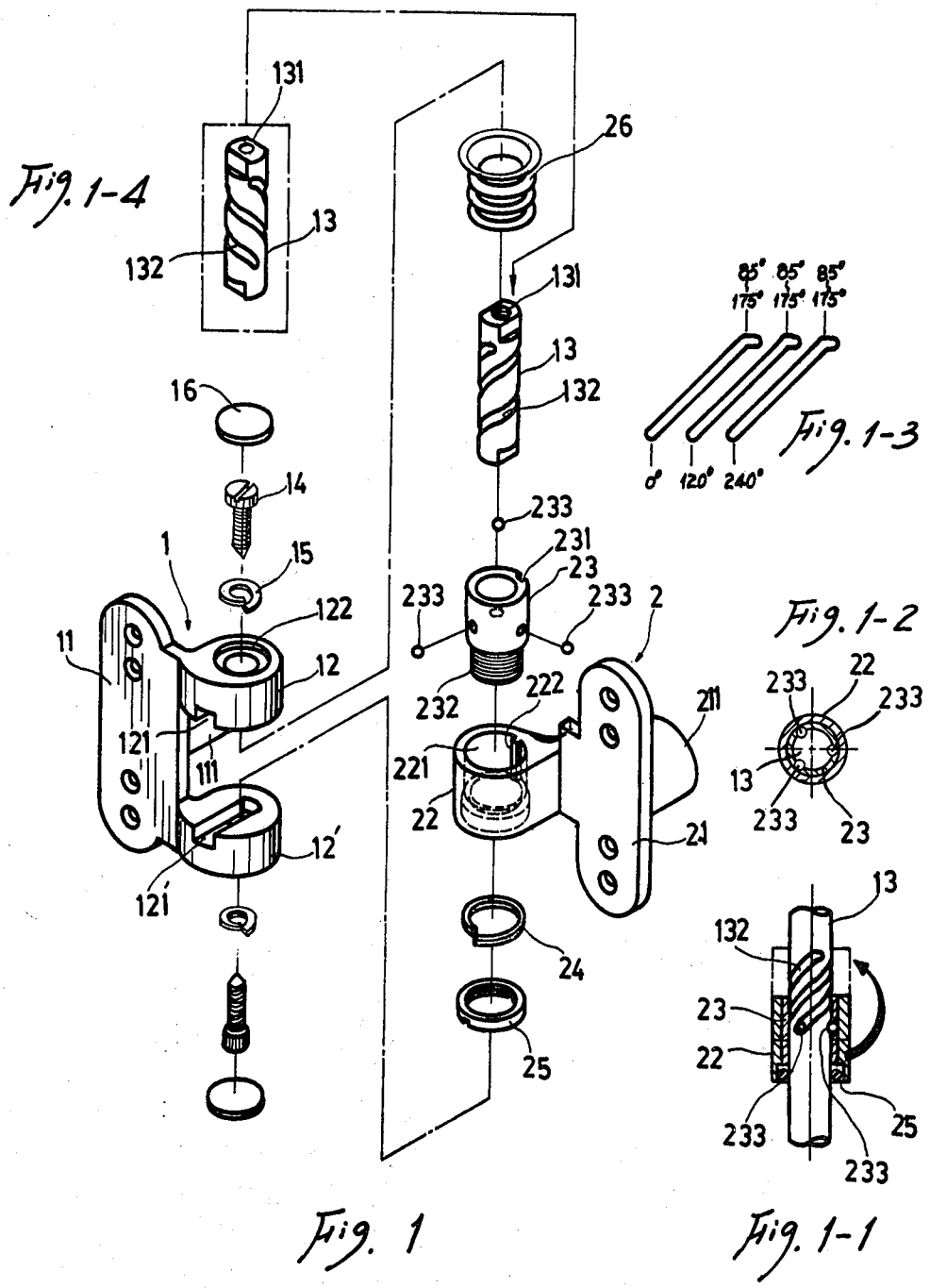
FIG. 1 shows the perspective and exploded views of the embodiment of primary hinge in this invention.

Now, this invention will be illustrated in detail with reference to the figures concerned as follows:

FIG. 1 shows the perspective and exploded views of the primary hinge which comprises a leftside primary hinge piece(1) to be installed to the upper portion of the jamb(3), and a rightside primary hinge piece(2) to be installed to the upper portion of the door(4). As shown in FIG. 1, the locating piece(11) of said leftside primary hinge piece(1) is furnished with a set of axle sets(12, 12') which have locating grooves(121,121') at the inner side of each of said axle seats in apposite corresponding position; said locating groove is designed for inserting the flat end of the axle rod(13) therein.

In the back side of said locating piece(11), a stub(111) is furnished for positioning in a hole (not shown in figure) pre-furnished in the upper portion of jamb(3) to locate said locating piece(11), which is to be fixed to the same upper portion of jamb with screws.

On the both ends of said axle seats(12,12'), there is a thru-staircase shaped screw hole(122, 122'); upon said axle rod(13) being positioned between the two axle seats(12,12'), said axle rod(13) will be fixed with a screw(14)(14'), a spring washer(15)(15') being fitted into the screw hole(131); then, the protection lids(16)(16') being fitted over said staircase-shaped screw holes(122)(122') for preventing any dirt from entering, and for better appearance as well. The locating piece(21) of said right side primary hinge piece(2) is furnished with a sleeve(22) to be positioned between said two axle seats(12,12') of the left side primary hinge piece(1); the center of said sleeve(22) has a thru-hole(221) to place the axle sleeve(23) therein with a dovetailed joint between the flange(222) on the sleeve(22) and the groove(231) on the axle sleeve(23); then, the spring washer(24) and the nut(25) are fitted to the bottom threads(232) of said axle sleeve(23) for fixing said axle sleeve(23) in the sleeve(22).

Around the axle sleeve(23), three locating balls(233) are furnished at the same level, being separated at an angle of 120°; their position is designed on the basis of distributing the pressure evenly among three points, likewise, in the back of the locating piece(21) of the right side primary hinge piece(2), a stub(211) is furnished to fulfill the same function as that of left side primary hinge piece(1).

Figure 3:
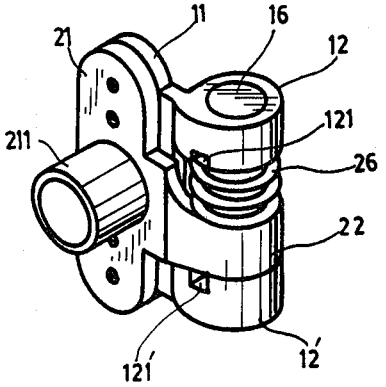
Figure 6:
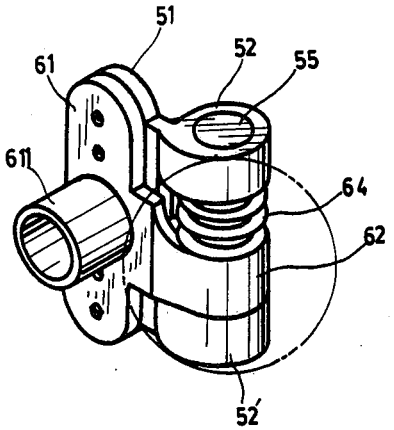
FIG. 6 shows the secondary hinge being installed in place (door being closed).
Figures 1, 6:
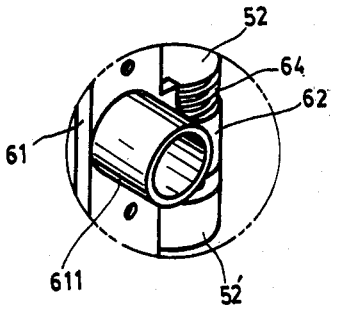
Figures 2, 6:
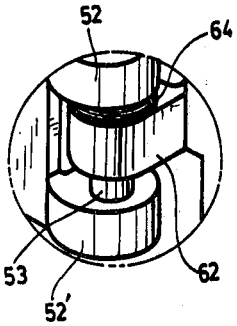

The axle rod(13) to be inserted inside the axle sleeve(23) is furnished with three slantingly upward spiral grooves(132), which are so designed that they are separated at an angle of 120° so as to fit said three locating balls(233) upon being placed into said axle sleeve(23), as shown in FIG. 1-1 and 1-2. The aforesaid spiral groove(132) has an upwards slanting angle ranging from 85°–175°, and has a short horizontal groove on the top of said spiral groove(132) as shown in FIG. 1-3. The aforesaid spiral groove(132) may be designed in either rightwards sprial or leftwards spiral, as shown in FIG. 1-4, but their function remains the same. Upon the axle rod(13) being placed inside the axle sleeve(23), the both ends of said axle rod(13) will extend outside the sleeve(22), and will be inserted into the locating grooves(121) of the leftside primary hinge piece(1) respectively. Between the top end of the axle rod(13) and the axle seat(12), an elastic rubber sleeve(26) is mounted, and can be stretched up and compressed down together with the moving sleeve(22) for preventing any dirty matter from entering therein.

Upon said primary hinge being installed to the upper portion of the jamb(3) and the door(4) as shown in FIG. 2, and when opening the door(4), the door(4) wll move upwards slightly as a result of the sleeve(22) driving the axle sleeve(23) around the axle rod(13) to rotate by means of the locating balls (233) rolling upwards slantingly along the spiral grooves(132).

As soon as the door opening operation is done, the door(4) will automatically return to the shutting position as a result of the gravity effect of the door(4).

Figure 4:
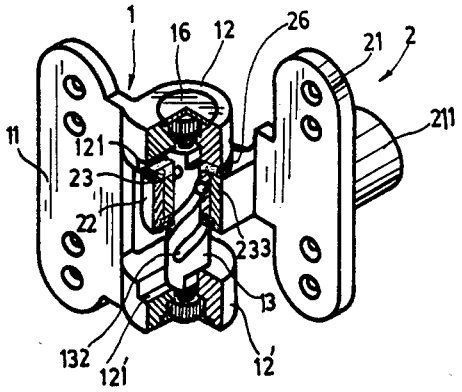

When opening the door(4) for a given period of time, the door(4) should be opened to an angle such that the locating balls(233) will roll over the top of the spiral groove(132), and enter into the horizontal groove. Now, the door(4) will remain opened until someone pushes the door(4) towards the opposite direction to such an extent that the locating balls(233) will be able to roll out of the horizontal grooves, and roll into the spiral grooves(132) again; then, the door will be shut automatically as a result of gravity effect of door itself. FIGS. 3 and 4 show the relative positions of the left side primary hinge piece(1) and the right side primary hinge piece(2) during the door(4) in opening and shutting state. Also, notice the change in the position of the sleeve(22) of the right side primary hinge piece(2), and the change of said elastic rubber sleeve(26), i.e., when the door(4) being shut, the sleeve(22) and the axle seat(12') are in closer position, and said elastic rubber sleeve(26) is in normal stretch manner, as shown in FIG. 3. When the door(4) is opened, said sleeve(22) becomes much closer to the lower part of axle seat(12), and said elastic rubber sleeve(26) is compressed; that condition can also be shown with the sectional view of the related position between the locating balls (233) and the spiral grooves(132).

One of the most important points to be considered in designing a general automatic return hinge is their common axis line between the upper and the lower hinges; if the common axis line is not properly aligned, the door will be unable to return its shutting position smoothly. The factors causing the door not to close smoothly are usually: the installation technique, alignment, deviation caused by being used for a period time during which the gravity effect of door itself and the impact during opening and shutting operation, etc. In order to improve the aforesaid factors, this invention has been furnished with a universal correction means.

Figure 5:
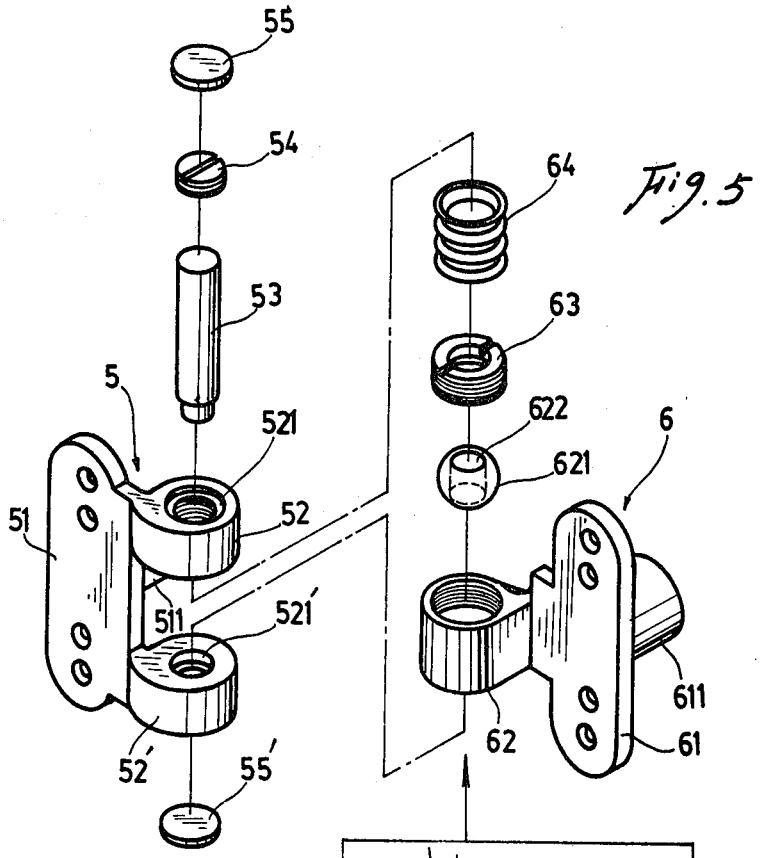
FIG. 5 shows the perspective and exploded views of the embodiment of secondary hinge of this invention.
Figures 1, 5:
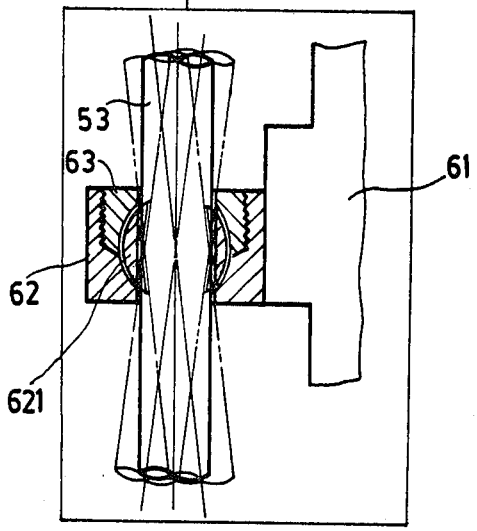

As shown in FIG. 5, the secondary hinge looks similar to the primary hinge except for the axle rod(53) of secondary hinge having no spiral groove. Said secondary hinge comprises a left side secondary hinge piece(5) and a right side secondary hinge piece(6), and on the back of the locating piece(51) of said left side secondary hinge piece(5), there is also a stud (511) for positioning. At one side of said locating piece(51), two axle seats(52,52') are furnished. Likewise, on the back of the locating piece(61) of the right side secondary hinge piece(6), a stub(611) is furnished for positioning. At one side of said locating piece(61), a sleeve(62) is furnished; inside the sleeve(62), a steel ball(621) with a thru hole(622) is furnished, and is to be fixed there with the sleeve nut(63). After said steel ball(621) being placed into the sleeve(62), a little play will exist between them according to the original design so as to let said steel ball(621) rotate. During installation, put the sleeve(62) of the right side secondary hinge piece(6) in between the axle seats(52, 52') of the leftside secondary hinge piece(5) first, and then put the axle rod(53) thru the staircase-shaped screw hole(521), the elastic rubber sleeve(64), the sleeve nut(63), the steel ball(621) and the staircase-shaped hole(521'); then; fix the axle rod(53) in position by fitting the screw(54) into the staircase-shaped screw hole(521) of the axle seat(52). Finally, mount the two protection covers (55,55') on the end of the two axle seats(52,52') respectively for preventing any dirt from entering therein. FIG. 5-1 shows the fitting condition of the axle rod(53) and the steel ball(621) in swinging rotation for universal correction. Whenever the door(4) has a deviation, the axle rod(53) will rotate to perform universal correction automatically by means of the special characteristics of swinging rotation of said steel ball(621). The aforesaid characteristics in this invention is not possessed by the general automatic return door hinges.

Figure 7:
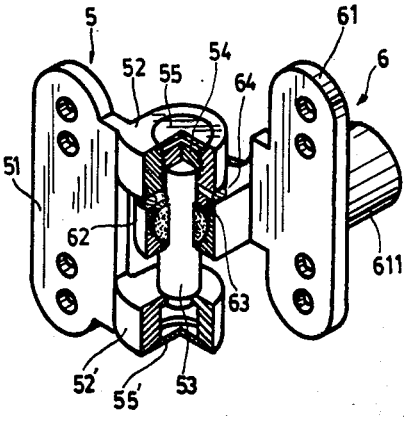
FIG. 7 shows the sectional view of the secondary hinge (in opening manner).

FIGS. 6 and 7 show the changes in relative positions of the secondary hinge pieces during opening or closing the door(4). In FIG. 6, the sleeve(62) of right side secondary hinge piece(6) is close to the axle seat(52') during the door(4) being shut, and the elastic rubber sleeve(64) is in normal stretch condition. During the door(4) in open condition, the sleeve(62) has moved near the bottom of the axle seat(52), and the elastic rubber sleeve(64) has been compressed as a result of the door(4) rotating upwards. From FIG. 7, the sectional view, we also can see the relative positions between the axle rod(53) and the steel ball(621).

FIGS. 6-1 and 6-2 show an enlarged view of the portion encircled with dotted line in FIG. 6. FIG. 6-1 shows the door (4) in shutting condition, and FIG. 6-2 shows the door(4) in opening condition.

According to the design in this invention, the door(4) will move slightly upwards when being opened; since the door(4), upon being shut, will be in coincidence with the jamb(3), it will, upon being opened, impact with the jamb(3), and will be unable to move upwards during opening; consequently, the top edge of the door(4) (i.e., the corresponding top surface of door(4) to that of the lintel) has to be cut into such a slant surface that the door(4) can smoothly leave the jamb to move upwards after opening a small angle.

The angle of the top surface of the door is determined in accordance with the thickness of each door, or in accordance with the coincident extent between the door(4) and the jamb(3); for further detail, see FIG. 8-1.

In addition to installing to the right side of the door(4) for counter-clockwise opening, this invention may, if necessary, be installed to the left side of the door(4) for clockwise opening. When changing the installing position, just exchange and reverse the left and right side primary hinge pieces(1,2), and change the direction of the spiral grooves(132) on the axle rod(13); also, refer to FIG. 8 and 9 for more details.

FIG. 10 shows another embodiment of the door hinge in this invention, of which the difference from the aforesaid hinge is that an angle of 90° is maintained between the right and left side hinge pieces of the primary and the secondary hinges during door being closed. In installing, the right side hinge piece will not be attached to the door(4) edge; instead, it will be installed to one side of the door(4); refer to FIG. 11 for more details; however, the components and the design of the hinge remain the same as that of the aforesaid hinges.

For the outer shape of the hinges, it may be designed in any other patterns in addition to the square pattern shown in FIG. 10.

The aforesaid hinge maintaining a 90° angle between its hinge pieces can also meet the requirement of having the door(4) being opened counter-clockwise or clockwise; for further details, see FIGS. 12 and 13.

I claim:

1. An automatic return hinge comprising one primary hinge and one secondary hinge, and said primary hinge including a left side primary hinge piece to be attached to a suitable upper portion of the jamb, and a right side primary hinge piece to be attached to a suitable upper portion of the door, and a locating piece of said right side primary hinge piece being furnished with a sleeve in which an axle sleeve being fitted, and around said axle sleeve, three locating balls being mounted at an equal distance of 120° angle, and in said axle sleeve fitting an axle rod with three slantingly upwards spiral grooves separated at an equal distance of 120° angle so as to match said three locating balls; and at one side of a locating piece of the left side primary hinge piece, having two axle seats with locating grooves in corresponding position; and when the sleeve of said right side primary hinge piece being placed in between the two axle seats of the left side primary hinge piece, the flat ends of the axle rod then being inserted into said locating grooves, and being fixed with screws; and when opening the door moving upwards slightly as a result of the matching function of said spiral grooves and said locating balls, and upon the door opening being over, the door automatically returning to shutting position as a result of door gravity effect.

2. An automatic return hinge as claimed in claim 1, wherein the secondary hinge includes a right side secondary hinge piece to be attached to the lower portion of the door, and a left side secondary hinge piece to be attached to the lower portion of the door, and their shape being the same as that of said left and right side primary hinge pieces; and inside the sleeve nut of said right side secondary hinge piece, installing a steel ball with a thru hole and being so fixed by a sleeve nut that said steel ball having some play for swingingly rotating; and an axle rod being placed inside the steel ball and to be fixed in between the two axle seats of said left side secondary hinge piece, and said axle rod having no spiral groove but by means of the characteristics of swingingly rotating of the steel ball to make universal correction to any deviation of the door.

3. An automatic return hinge as claimed in claim 1, wherein on the back of said locating piece of the left and right side primary and secondary hinge piece, a stub is furnished and is to be placed inside the locating holes of the door and the jamb respectively during installation for positioning purpose.

4. An automatic return hinge as claimed in claim 1, wherein the three spiral grooves on the axle rod are separated at an angle of 120°, having the whole pressure being distributed evenly to the three balls, and each of said grooves having a slantingly ascending angle ranging from 85°–175°; and on the top of each said spiral groove, a suitable length of horizontal groove being extended so as to have the door maintaining in open condition, if necessary, without returning to shutting position automatically as a result of said locating balls having rolled into said horizontal groove.

5. An automatic return hinge as claimed in claim 1, wherein the said left and right side hinge pieces may be designed to have an angle of 90° between them without changing the original functions.

* * * * *